US006139047A

United States Patent [19]

Kim

[11] Patent Number: 6,139,047

[45] Date of Patent: Oct. 31, 2000

[54] GOLF BAG EQUIPPED WITH DETACHABLE CARRIER

[75] Inventor: Jung Han Kim, Seoul, Rep. of Korea

[73] Assignee: King Tiger Corp., Rep. of Korea

[21] Appl. No.: 09/363,785

[22] Filed: Jul. 29, 1999

[30] Foreign Application Priority Data

May 21, 1999 [KR] Rep. of Korea ..... 99-18437

[51] Int. Cl.[7] ..... B62B 1/04

[52] U.S. Cl. ..... 280/646; 280/655; 280/47.26; 280/DIG. 6

[58] Field of Search ..... 280/40, 645, 646, 280/42, 652, 655, 655.1, 47.18, 47.26, DIG. 6

[56] References Cited

U.S. PATENT DOCUMENTS

| | | | |
|---|---|---|---|
| 3,223,430 | 12/1965 | Fitsimmons | 280/DIG. 6 |
| 3,266,814 | 8/1966 | Dawson | 280/DIG. 6 |
| 5,799,967 | 9/1998 | Lin | 280/646 |
| 5,957,543 | 9/1999 | Wa | 280/DIG. 6 |

FOREIGN PATENT DOCUMENTS

| | | |
|---|---|---|
| 516437 | 9/1955 | Canada . |
| 132087 | 6/1951 | Sweden . |

*Primary Examiner*—Richard M. Camby
*Attorney, Agent, or Firm*—Snell & Wilmer L.L.P.

[57] ABSTRACT

The present invention relates to a golf bag equipped with a detachable carrier 1. The golf bag equipped with a carrier comprising: a supporting plate 100 attached to the outer peripheral edge of said golf bag; a main plate 200 fastened to said supporting plate 100 at the position of the outer peripheral edge of said golf bag; a leg unit 300 rotatably coupled with the front face of said main plate 200; a main bearing unit 210 coupled with the front face of said main plate 200 for controlling the angle of said leg unit 300; first bearing units 220 being attached or detached in opposing each other at both sides of said main bearing unit 210; an adjusting unit 230 for coupling said first bearing units 220 with said main bearing unit 210 or separating said first bearing units 220 from said main bearing unit 210; a cover 260 coupled with the front face of said main plate 200; a wheel unit 400 coupled with the lower part of said leg unit 300 for moving said golf bag; and a handle unit 500 coupled with the upper side of the outer peripheral edge of said golf bag. The present invention provides a golf bag equipped with a carrier capable of simply and conveniently carrying the golf bag by coupling the carrier to the body of the golf bag without a separate cart. In non-use, it is capable of keeping the golf bag and the carrier in separated state or packing them in a box. Also, it is capable of easily adjusting the angle of the carrier while carrying the golf bag and standing it on the ground. Furthermore since the golf bag has a simple construction and a small number of parts, and the wheel unit is able to be separated, it is capable of easily replacing the damaged parts when problems are generated.

12 Claims, 9 Drawing Sheets

GOLF BAG EQUIPPED WITH DETACHABLE CARRIER

BACKGROUND OF THE INVENTION

1. Field of the Invention

The present invention relates to the field of golf implements and accessories. More specifically, the present invention relates to a golf bag equipped with a detachable carrier that is particularly designed to provide wide utility to a golfer and enhance the enjoyment and convenience of the game.

2. Description of the Prior Art

In case of a conventional golf bag, it is difficult for the golfer to carry it in a wide golf course that golf is played on because the golf bag is designed to be carried on his/her shoulder or in his/her hand. Accordingly the greater part of golfers make use of separate carrying devices such as golf carts or golf carriers or go with caddies to carry the golf bag for them who are playing golf. Nevertheless carrying the golf bag is still troublesome due to the weight and volume of the carrying device itself.

In this reason, the golf bag equipped with a carrier has been developed. However since several such brands and styles of a golf bag carrier known and widely used on golf courses have many parts and complicated structures to adjust the angle of the carrier, it is difficult to manipulate the carrier and manufacturing costs become rising. Also, since the conventional golf bag carrier is mounted to the mediate between left side and right side of the golf bag, the golf bag is hung down due to the weight thereof, thus the connection part between the carrier and the golf bag is capable of easily being damaged. When the connection part is damaged, it is difficult to exchange only the damaged part due to the complicated construction, thus the entire of the golf bag carrier must be repaired.

SUMMARY OF THE INVENTION

Accordingly, the present invention has been made keeping in mind the above problems occurring in the prior art, and an object of the present invention is to provide a golf bag equipped with a carrier which is capable of easily carrying the bag in any ground state and securely making it stand on the ground by simply and easily operating the angle of the carrier with respect to the golf bag.

Another object of the present invention is to provide a golf bag equipped with a carrier that is capable of easily being detached from the bag in non-use or in packing.

A further object of the present invention is to provide a golf bag equipped with a carrier that is capable of preventing it from being damaged due to the hang down phenomenon of the golf bag.

A further another object of the present invention is to provide a golf bag equipped with a carrier which is capable of easily carrying it in a comfortable posture by freely manipulating the angle of the handle when a golfer or a caddy carries it on the field.

A further another object of the present invention is to provide a golf bag equipped with a carrier which has a simple construction and a small number of parts, thereby remarkably reducing possibilities of troubles and weights of it.

A further another object of the present invention is to provide a golf bag equipped with a carrier which is capable of easily detaching/attaching wheels of the carrier according to an user's intention, thereby resolving the trouble of assembling work due to the size or weight of the carrier.

In order to accomplish the above objects, a golf bag equipped with a carrier according to the present invention comprises: a pair of supporting plates fixed in a body of the golf bag; a pair of main plates detachably mounted to the supporting plates; a pair of leg units rotatably/fixedly mounted to the main plates; a pair of wheel units engaged with the lower end of the leg units; and a handle unit engaged with the upper side of the body of the golf bag.

BRIEF DESCRIPTION OF THE DRAWING

These and other objects and advantages of the present invention will be more clearly understood from the following detailed description taken in conjunction with the accompanying drawings, in which.

Figure 1:
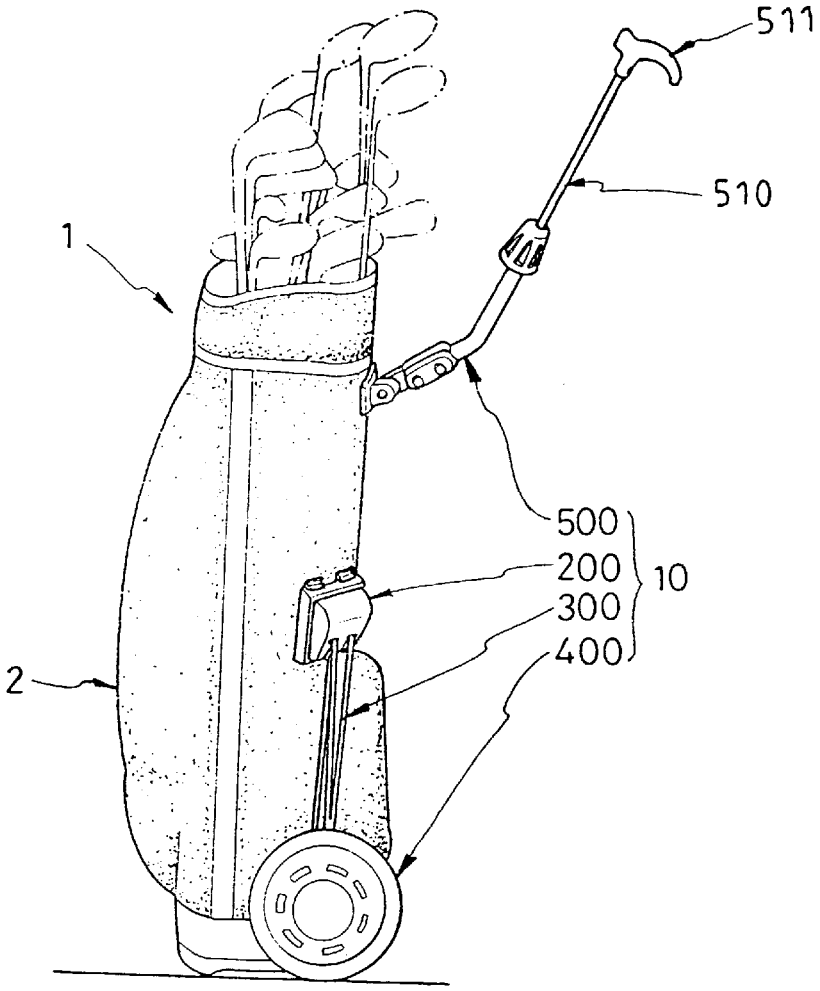
FIG. 1 is a perspective view showing a folding state of the golf bag equipped with a detachable carrier in accordance with an embodiment of the present invention.

| Reference Numeral in Drawings | |
|---|---|
| 1; golf bag | 2: body |
| 10; carrier | 100; supporting plate |
| 110; supporting unit | 120; fastening unit |
| 200; main plate | 210; main bearing unit |
| 211; protruding block | 212; shaft hole |
| 213; hooking jaw | 214; saw teeth surface |
| 215; spring | 220; first bearing unit |
| 221; operating block | 230; adjusting unit |
| 231; shaft | 234; cam |
| 236; lever | 240; fastening unit |
| 241; fastening instrument | 244; spring |
| 245; operating member | 247; operating button |
| 249; spring | 250; supporting unit |
| 260; cover | 261; elongated guide slot |
| 262; first guide groove | 263; second guide groove |
| 270; second bearing unit | 300; leg unit |
| 310; first leg | 320; second leg |
| 330; trailing assembly | 400; wheel unit |
| 410; tire | 540; length adjusting instrument |

DETAILED DESCRIPTION OF THE PREFERRED EMBODIMENT

The golf bag equipped with a detachable carrier according to the present invention is below described with reference to the accompanying drawings. The preferred embodiments described in this specifications describe only typical examples but have no intentions to restrict the scope of the present invention.

Figure 2:
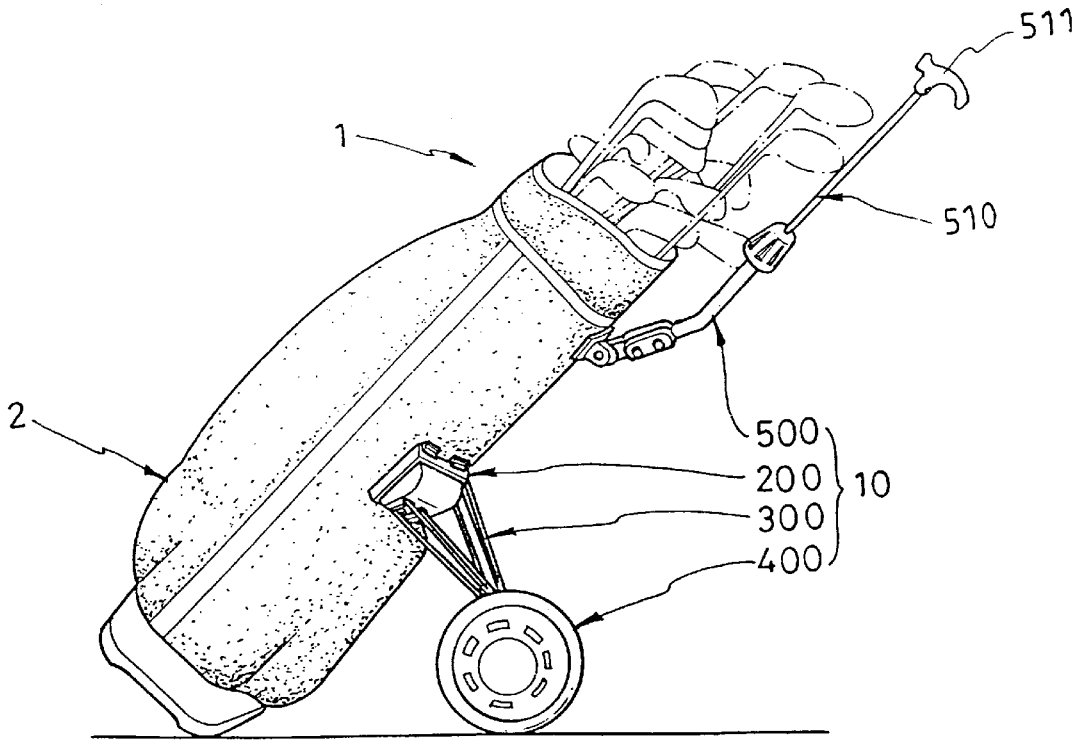
FIG. 2 is a perspective view showing a unfolding state of the golf bag equipped with a detachable carrier in accordance with the embodiment of the present invention.
Figure 3:
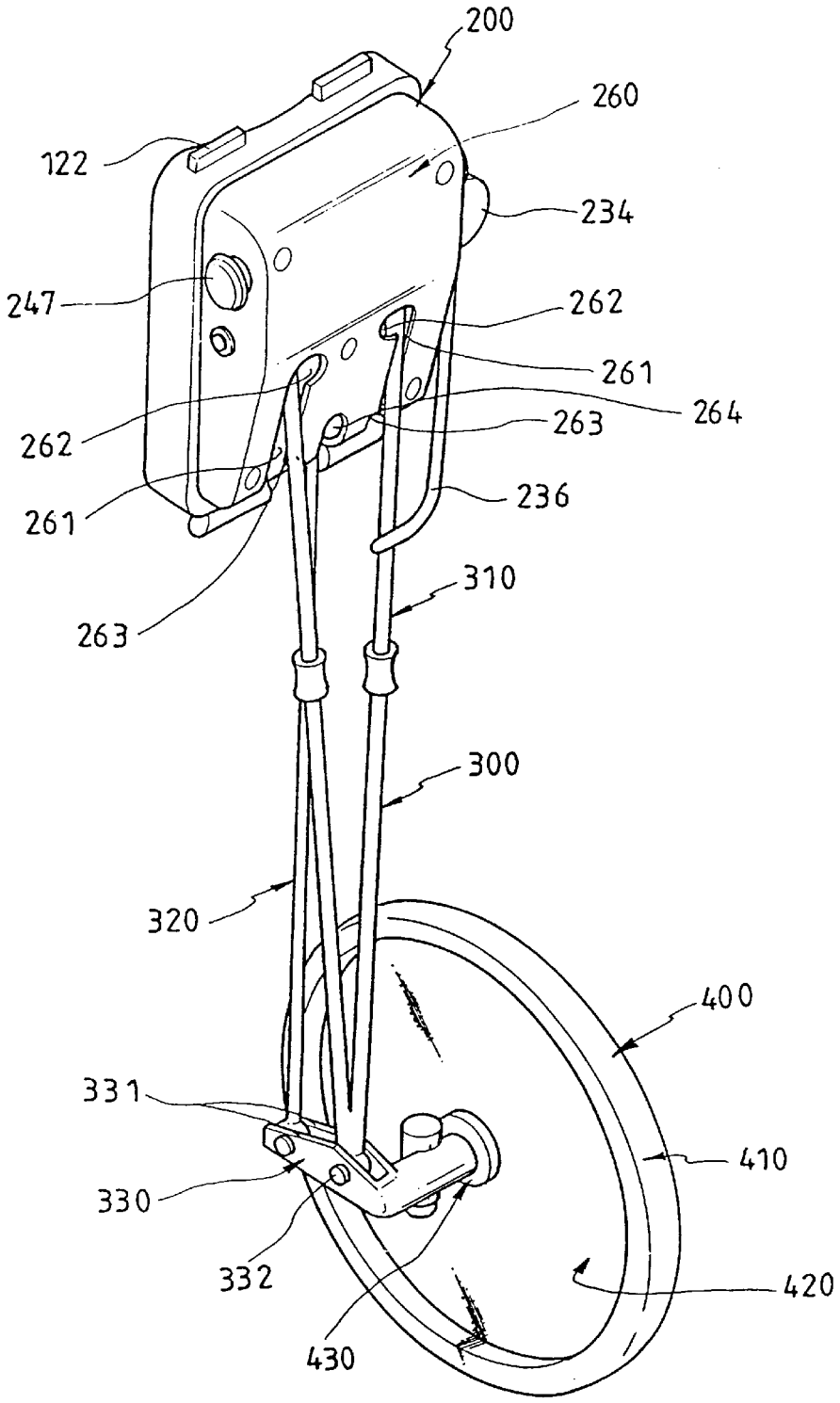
FIG. 3 is a detailed perspective view showing the carrier in accordance with the embodiment of the present invention.
Figure 4:
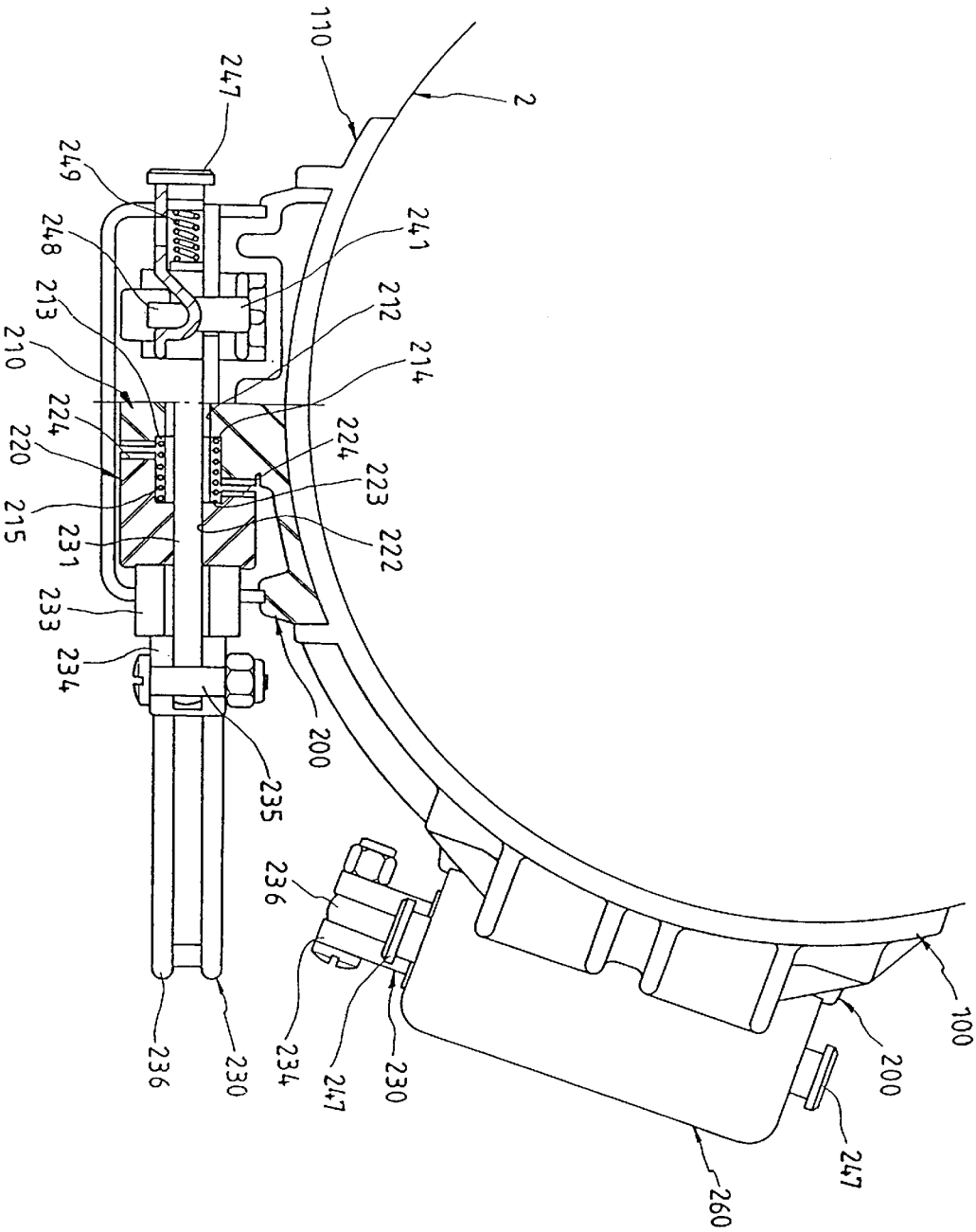
FIG. 4 is a cross-sectional view showing a part of the golf bag body in accordance with the embodiment of the present invention.
Figure 5:
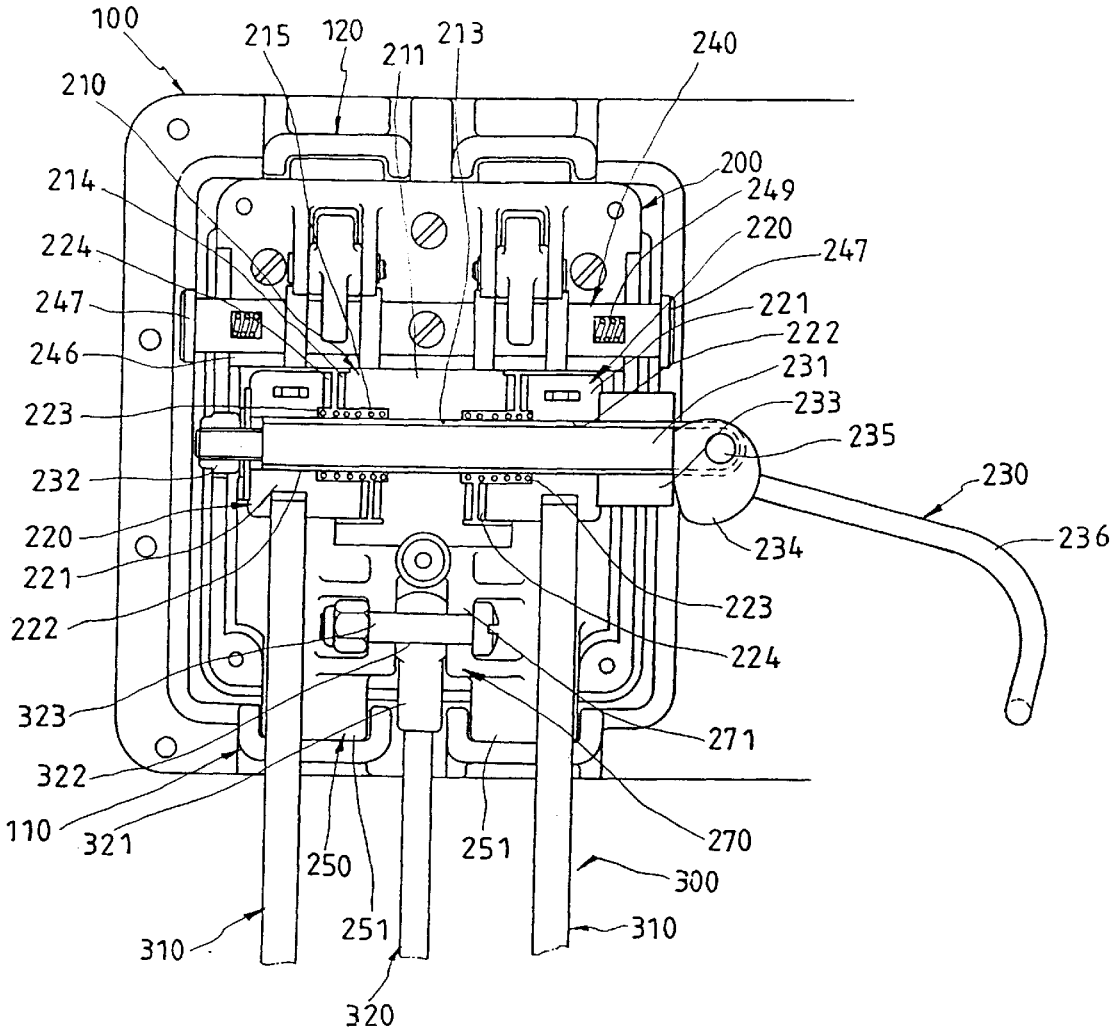
FIG. 5 is a front view showing an unlocking state of the operating means installed to the main plate of the carrier from which a cover is removed in accordance with the embodiment of the present invention.
Figure 6:
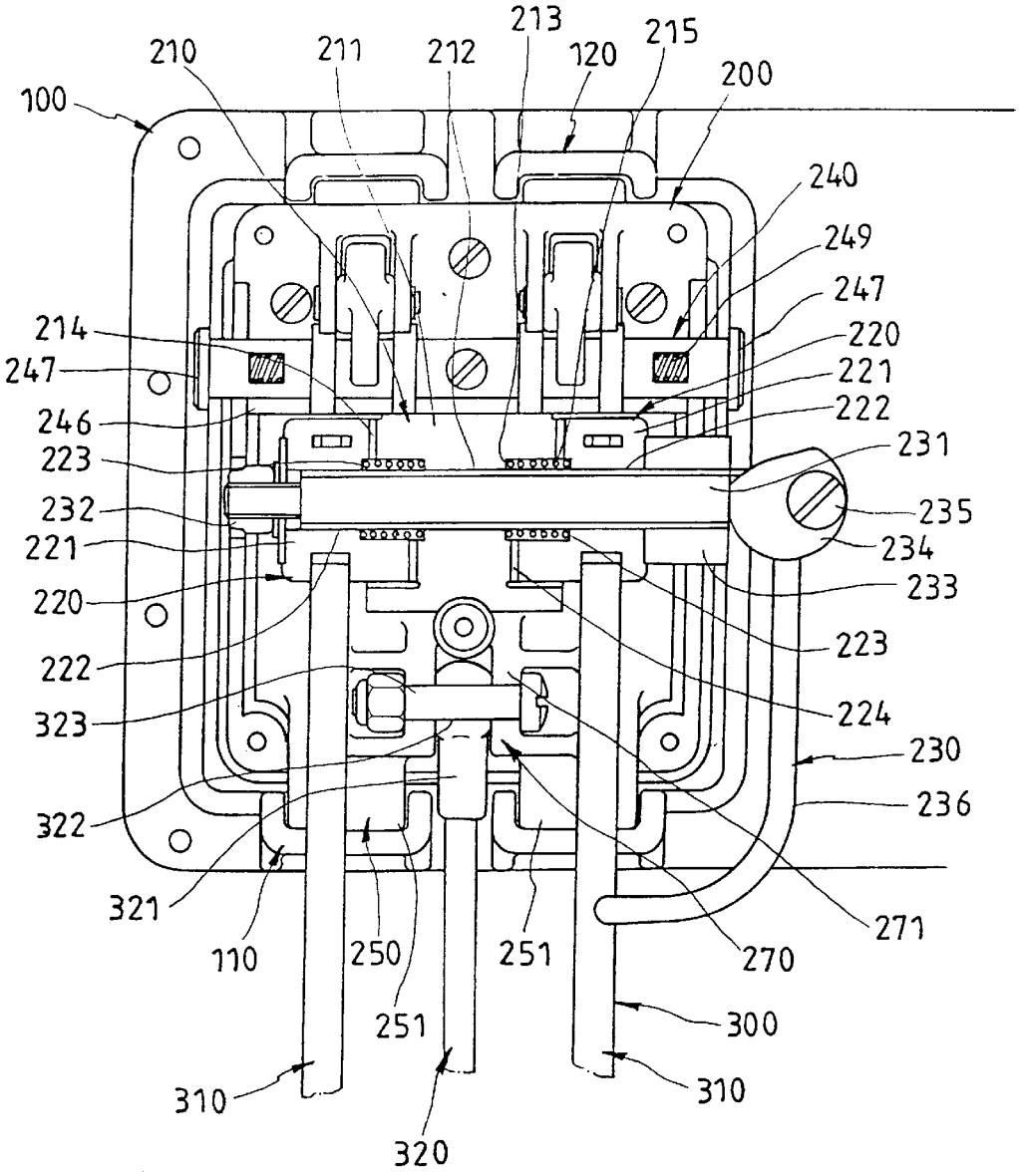
FIG. 6 is a front view showing a locking state of the operating means installed to the main plate of the carrier from which a cover is removed in accordance with the embodiment of the present invention.
Figure 7:
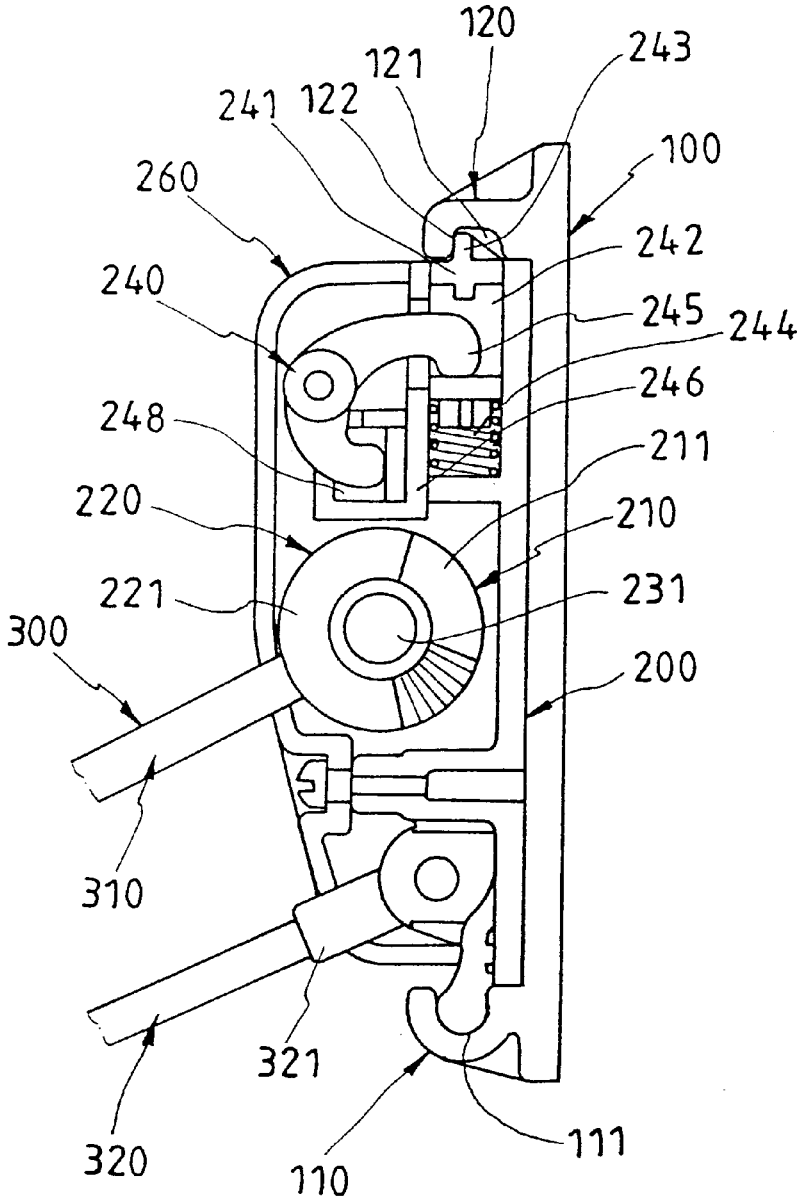
FIG. 7 is a longitudinal sectional view showing a state in installing an operating means to the main plate in accordance with the embodiment of the present invention.
Figure 8:
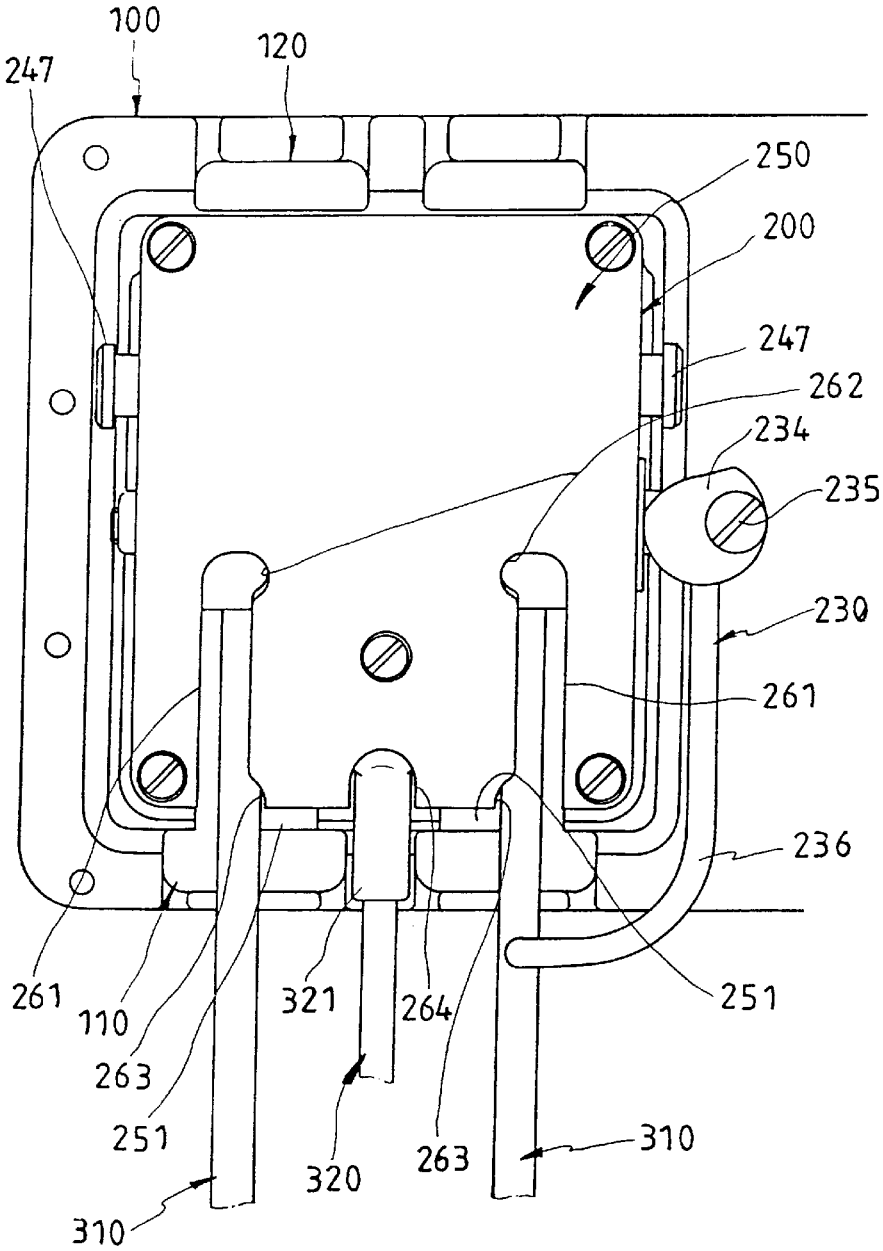
FIG. 8 is a front view showing a cover engaged with the main plate of the carrier in accordance with the embodiment of the present invention.
Figure 9:
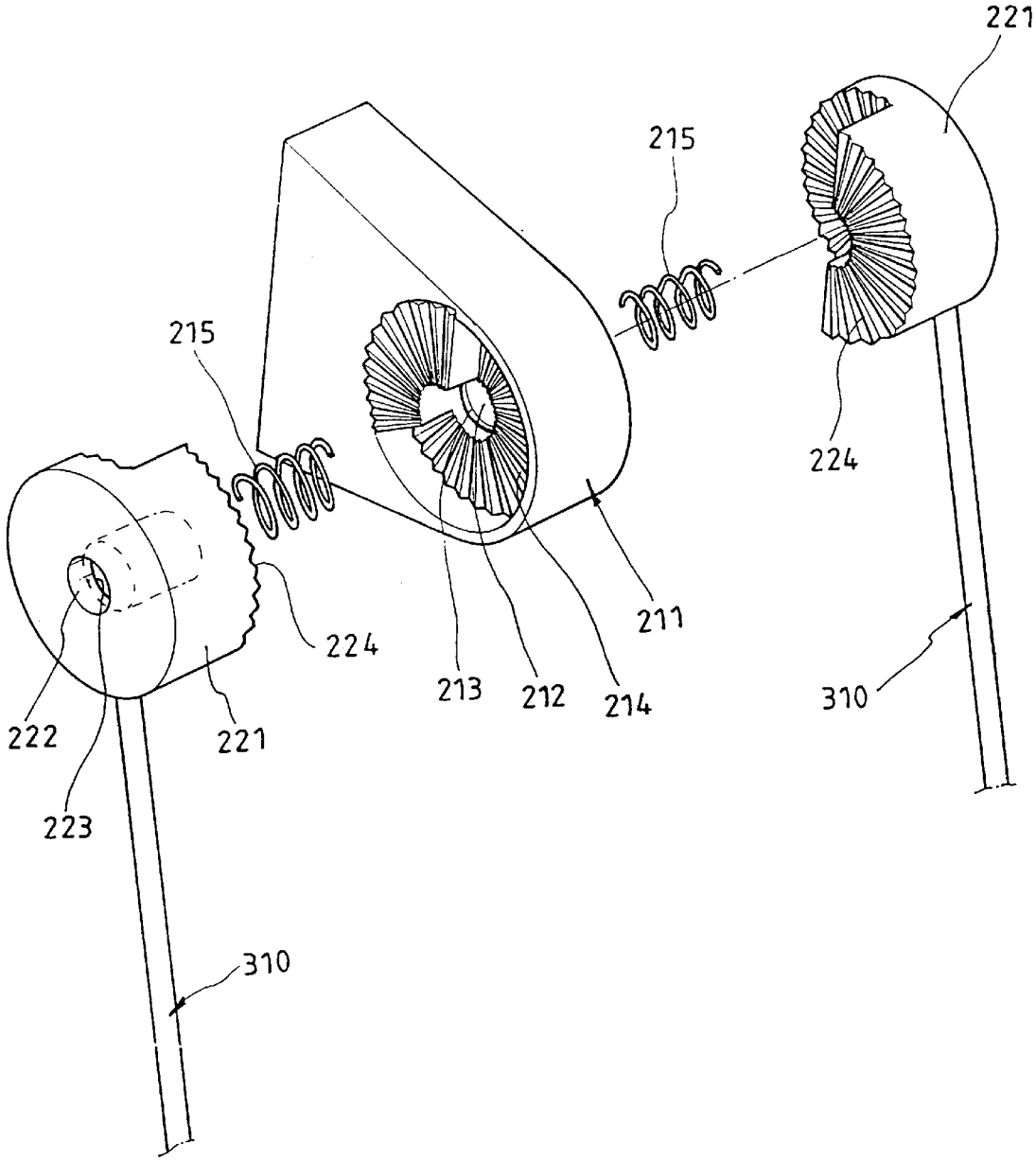
FIG. 9 is a detailed exploded perspective view showing an operating unit of the carrier in accordance with the embodiment of the present invention.

Referring to FIGS. 1 to 9, a carrier 10 is detachably mounted to the body 2 of a golf bag 1. The carrier 10 comprises a pair of supporting plates 100, a pair of main plates 200, a pair of leg units 300, a pair of wheel units 400, and a handle unit 500.

The supporting plates 100 are curved plate shaped members for detachably mounting the main plates 200 to the body 2 of the golf bag 1. The supporting plates 100 are closely attached to the inner peripheral edge of the body 2 of the golf bag 1. Fastening unit 120 and supporting unit 110 are formed at the upper part and lower part of the front face of the main plate 200 so that the body 2 of the golf bag 1 is closely attached to the outer peripheral edge thereof. Also the supporting plates 100 consist of a left half part and right half part. Herein, the supporting unit 110 comprises a hooking groove 111 formed at both sides of the lower part of the front face of the supporting plate 100. Also, the fastening unit 120 is protruded from the upper part of the supporting plate 100 so that its bottom surface is open to form an insertion space 121. Accordingly, a hooking jaw 122 is formed at the front face of the insertion space 121.

The main plate 200 comprises a main bearing unit 210 for rotatably supporting the upper end of a first leg 310, first bearing units 220 attached to the both sides of the main bearing unit 210 or detached from them, an adjusting unit 230 for controlling the attachment and detachment operations of the first bearing unit 220 with respect to the main bearing unit 210, a second bearing unit 270 rotatably supporting the upper end of a second leg 320, a fastening unit 240 mounted to the fastening member 120 of the supporting plate 100 for detaching/attaching the main plate 200, a supporting unit 250 having a hooking piece 251 hooked in the hooking groove 111 of the supporting unit 110 for supporting the lower part of the main plate 200, and a cover 260 engaged with the front face of the main plate 200 for protecting the parts mounted to the main plate 200 and guiding the first leg 310.

The main bearing unit 210 comprises a protruding block 211 formed at the center of the main plates 200. The protruding block 211 includes a shaft hole 212 formed to pass through its center. A spring 215 is inserted into the hole 212 which has hooking jaws 213 formed therein. The protruding block 211 consists of two stepped parts on which saw teeth are formed in radial shape.

The first bearing units 220 are installed so that the operating blocks 221 are positioned at both sides of the protruding block 211 of the main bearing unit 210. Each of the operating block 221 includes a shaft hole 222 passing through its center. A hooking jaw 223 is formed in the shaft hole 222 so that the spring 215 is hooked on the hooking jaw 223. Herein, the operating block 221 comprises two stepped parts that are formed to correspond to the stepped parts of the protruding block 211. Also saw teeth are formed on the surface of the operating block 221. Accordingly, when the protruding block 211 is engaged with the operating block 221, a predetermined space is formed at the position of the stepped parts.

The shaft 231 is inserted into the shaft hole 212 of the protruding block 211 and the shaft hole 222 of the operating block 221 by controlling the adjusting unit 230. In this state, the supporting instrument 232 and guide instrument 233 are coupled with both ends of the shaft 231. The shaft 231 passing through a guide instrument 233 may be moved in horizontal. The one end of the shaft 231 is exposed to the outside. A cam 234 is coupled to the exposed shaft 231 by a pin 235. The lever 236 is attached to the cam 234 so as to control the rotation of the cam 234.

The fastening unit 240 consists of a pair of fastening instruments 241 for detaching/attaching the main plates 200 by the movement of upward or downward direction, a pair of operating members 245 for moving the fastening instruments 241 in upward and downward directions, a pair of operating buttons 247 for controlling the operation of the operating members 245, and an auxiliary plate 246 for guiding the fastening instruments 241, the operating members 245 and the operating buttons 247. Herein, the fastening instrument 241 comprises a hooking piece 243 formed at the upper end thereof. The hooking piece 243 is formed in vertical to the insertion space 121. Also the fastening instrument 241 further comprises an insertion space 242 formed at the center part thereof, and a spring 244 mounted at the lower end part thereof. The one end of the operating members 245 is hooked in the insertion space 242. The spring 244 urges the fastening instruments 241 to move upward. Also, the operating member 245 is formed in a seesaw type to rotatably support the center part thereof with a pin. The upper end part of the operating member 245 is inserted into the insertion space 242. The operating member 245 pushes the fastening instruments 241 downward when the operating member 245 is rotated in constant. On the other hand, the operating button 247 is horizontally mounted so that it is opposed to the lower end part of the operating member 245. Also, the operating button 247 comprises a hooking groove 248 into which the lower end part of the operating member 245 is inserted. The outer surface of the hooking groove 248 is tapered so that the operating member 245 is guided along the tapered surface thereof. Accordingly, the operating member 245 is rotated in constant when the operating button 247 goes straight ahead. A spring 249 is mounted to the inner end of the operating button 247 so that the button 247 is protruded from the inside to the outside. Also the auxiliary plate 246 comprises guide pieces and holes formed at predetermined positions so that the straight ahead movement of the operating button 247, the swing movement of the operating member 245 and the up and down movement of the fastening instrument 241 are maintained in stable.

The supporting unit 250 comprises a pair of hooking pieces 251 formed to be protruded from the lower part of the main plate 200. The lower end of the hooking piece 251 is formed in cylindrical shape.

The cover 260 covering the front face of the main plate 200 comprises elongated guide slots 261 formed at both sides thereof to guide the first legs 310, first guide grooves 262 inwardly formed at the upper end part of each guide slot 261, and second guide grooves 263 inwardly formed at the lower end part of the guide slot 261 to guide the first leg 310 to the left side or right side thereof. Also the cover 260 comprises a guide groove 264 formed at the center part of the lower end part thereof to guide the second leg 320.

The leg unit 300 comprises a V-shaped first leg 310 for engaging the upper end part thereof, with the supporting block 221 of the first bearing unit 220, a second leg 320 rotatably engaged with a bracket 271 of the second bearing unit 270, and a trailing assembly 330 rotatably engaged with the lower end parts of the first and second legs 310 and 320.

The second leg 320 comprises a finishing member 321 mounted to the upper end part thereof, and a pin through hole 322 formed to pass through the finishing member 321.

The second leg 320 is rotatably engaged with the bracket 271 of the second bearing unit 270 by a pin 323.

The trailing assembly 330 comprises coupling pieces 331 formed in opposing each other at the upper side thereof. The lower end parts of the first and second legs 310 and 320 are inserted between the coupling pieces 331. They are rotatably coupled with a pin 332.

The wheel unit 400 comprises a wheel 420, a tire 410 coupled with the outer peripheral edge of the wheel 420, and a hub 430 formed at the center part of the wheel 420 and coupled with the rotational shaft 431 to smoothly rotate the tire 410.

Hereinafter, the work of the present invention is described.

Firstly, in order to the carrier 10 mounted to the body 2 of the golf bag 1 in the state that the carrier 10 is folded, the folded lever 236 is pulled up. At this time, the cam 234 is rotated by the spring force of the spring 215 inserted between the protruding block 211 and the operating block 221. As a result, the coupling state of the protruding block 211 and the operating block 221 is released. At the same time, the distance between the branched first legs 310 coupled with the operating block 221 is wide so that the legs are escaped from the second guide groove 263 and then are positioned to the lower end of the elongated guide hole 261. The lever 236 is pulled up to the position of the upper end of the elongated guide slot 261. Thereafter, the lever 236 is pulled down to control the rotation of the cam 234. Accordingly, since the shaft 231 is outwardly pulled by the reverse rotation of the cam 234, the operating block 221 is guided to the shaft 231. As a result, the saw teeth of the operating block 221 are closely fitted to the saw teeth of the protruding block 211. At the same time, the first legs 310 are inserted into the first guide grooves 262 that are formed at the upper ends of the elongated guide slots 261 of the cover 260. On the other hand, the protruding block 211 and the operating block 221 are gear-engaged by the saw teeth radically formed on opposing surfaces thereof. Accordingly, the state of the engagement can be securely maintained. Furthermore, the operating block 221 comprises two stepped parts, and also the protruding block 211 comprises two stepped parts opposing to those of the operating block 221 to be formed at a predetermined space between the opposing surfaces. Accordingly it is capable of accurately controlling the stroke of the rotational angle. On the other hand, since the second leg 320 is coupled to the second bearing unit 270 by the pin 323, it is always freely rotatable. That is, the leg 320 is rotated in interlocked with the rotation of the first legs 310. Also the lower ends of the first legs 310 and the second leg 320 are inserted between the coupling pieces 331 of the trailing assembly 330, and are coupled by the pins 332. Therefore, they are rotated in interlocked with the rotation of the first legs 310 and the second leg 320.

As above-described, when the first legs 310 and the second leg 320 of the carrier 10 installed to the body 2 of the golf bag 1 are fully widened, it is capable of using the golf bag 1 in an inclined state with respect to the bottom position of the body 2 and the right and left positions of the wheel unit 400 attached to the lower part of the leg unit 300. That is, since the body 2 of the golf bag 1 is substantially formed in cylindrical shape and the carrier 10 is installed at both sides of the outer peripheral edge of the body 2 in symmetry at a predetermined distance, the carrier 10 is closely attached to the outer peripheral edge of the body 2 in case of folding the legs 310 and 320. The carrier 10 is widened more than the diameter of the body 2 in case of unfolding the legs 310 and 320. Accordingly, it is capable of stably standing the golf bag 1 on the ground.

In this situation, the user is capable of adjusting the length and the angle of the handle unit 500.

In order to fold the carrier 10, the lever 236 is pulled up. At this time, the cam 234 is rotated by the spring force of the spring 215 inserted between the protruding block 211 and the operating block 221. As a result, the coupling state of the protruding block 211 and the operating block 221 is released to go away each other. At the same time, the distance between the branched first legs 310 coupled with the operating block 221 is widened so that the legs are escaped from the first guide grooves 262 and then are positioned to the upper ends of the elongated guide holes 261. The lever 236 is pulled down to the position of the lower end of the elongated guide slot 261. Thereafter, the lever 236 is further pulled down to control the rotation of the cam 234. At this time, since the shaft 231 is outwardly pushed by the reverse rotation of the cam 234, the operating block 221 is guide to the shaft 231. As a result, the operating block 211 is closed to the protruding block 211 and is inserted into the second guide groove 263 formed at the lower end of the elongated guide slot 261, and therefore the leg unit 300 is maintained with a folding state.

In order to detach the carrier 10 from the body 2 of the golf bag 1, the operating buttons 247 protruded from the both sides of the main plate 200 are pushed. At this time, the one end of the operating member 245 is guided to the inclined surface of the hooking groove 248 of the operating button 247, and then the operating member 245 is rotated so that the fastening instrument 241 is moved to its lower side to compress the spring 244. Accordingly, since the fastening instrument 241 which is inserted into the insertion space 121 of the fastening unit 120 and is hooked in the front face of the hooking jaw 122 of the insertion space 121 is moved to the lower side, the upper end of the fastening instrument 241 escapes from the insertion space 121 of the fastening unit 120. In this way, when the locking of the fastening instrument 241 is released, the main plate 200 is pulled forwardly, so that the hooking piece 251 of the supporting unit 250 hooked in the hooking groove 111 of the supporting unit 110 is released. Accordingly, the main plate 200 is completely separated from the supporting plate 100.

In order to attach the carrier 10 to the body 2 of the golf bag 1, the hooking piece 251 of the supporting unit 250 is inserted into the hooking groove 111 of the supporting unit 110. Thereafter, the upper side of the main plate 200 is closed to the supporting plate 100 while the operating button 247 is pushed. Also when the operating button 247 is pushed, the one end of the operating member 245 is guided to the inclined surface of the hooking groove 248, and then the operating member 245 is rotated. Accordingly, the other end of the operating member 245 inserted into the insertion space 242 of the fastening instrument 241 is rotated, so that the fastening instrument 241 is moved to the lower part while pushing the spring 244. In this situation, when the main plate 200 is completely closed to the body 2 of the golf bag 1 and then the pushed state of the operating button 247 is released, the fastening instrument 241 is moved to the upper side by the spring force of the spring 234. Accordingly since the upper hooking piece 243 of the fastening instrument 241 to be inserted into the insertion space 121 of the fastening unit 120 is hooked in the hooking jaw 122, the locking state is lastly maintained.

On the other hand, when the main plate 200 is separated from the body 2 of the golf bag 1, the separating work is implemented while pushing the operating button 237. However, when the main plate 200 is attached to the body 2, the hooking piece 251 of the first supporting unit 250 is inserted into the hooking groove 112 of the supporting unit 110, According to the above described construction, the engaging work is easily achieved by simply closing the main plate 200 to the supporting plate 100 without pushing the button 347.

As described above, the present invention provides a golf bag equipped with a carrier capable of simply and conveniently carrying the golf bag by coupling the carrier to the body of the golf bag without a separate cart. In non-use, it is capable of keeping the golf bag and the carrier in separated state or packing them in a box. Also, the present invention provides a golf bag equipped with a carrier capable of easily adjusting the angle of the carrier while carrying the golf bag and standing it on the ground. Furthermore, since the golf bag equipped with a carrier of the present invention has a simple construction and a small number of parts, and the wheel unit can be separated, it is capable of easily replacing the damaged parts when problems are generated.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A golf bag equipped with a carrier comprising:

a supporting plate attached to the outer peripheral edge of said golf bag;

a main plate fastened to said supporting plate at the position of the outer peripheral edge of said golf bag;

a leg unit rotatably coupled with the front face of said main plate;

a main bearing unit coupled with the front face of said main plate for controlling the angle of said leg unit;

first bearing units being attached or detached in opposing each other at both sides of said main bearing unit;

an adjusting unit for coupling said first bearing units with said main bearing unit or separating said first bearing units from said main bearing unit;

a cover coupled with the front face of said main plate;

a wheel unit coupled with the lower part of said leg unit for moving said golf bag; and a handle unit coupled with the upper side of the outer peripheral edge of said golf bag.

2. The golf bag as defined in claim 1, wherein said supporting plate comprises a supporting unit including hooking grooves which are formed at both sides of the front face of the said supporting plate, and a fastening unit including an insertion space formed to open the bottom surface thereof and a hooking jaw formed at the front face of said insertion space.

3. The golf bag as defined in claim 1, wherein said main plate comprises a main bearing unit for rotatably supporting the upper end of a first leg at the front face thereof, a first bearing unit coupled with said main bearing unit or separated from said main bearing unit, an adjusting unit for controlling the operation for coupling the first bearing unit with the main bearing unit and the operation for separating the first bearing unit from the main bearing, a second bearing unit for rotatably supporting the upper end of a second leg of said leg unit, a fastening unit coupled with said fastening unit of the supporting plate for detaching or attaching said main plate, a supporting unit including a hooking piece formed to be hooked on the hooking groove of said supporting plate for fixing the lower part of said main plate, and a cover coupled with the front face of said main plate for protecting the parts to be installed to said main plate and guiding said first leg.

4. The golf bag as defined in claim 1, wherein said main bearing unit comprises a protruding block protruded from the center part of said main plate, said protruding block has a shaft hole into which a spring is inserted, protruding blocks formed at both sides thereof, and saw teeth surfaces formed at both sides of said protruding block.

5. The golf bag as defined in claim 3, wherein said main bearing unit comprises a protruding block protruded from the center part of said main plate, said protruding block has a shaft hole into which a spring is inserted, protruding blocks formed at both sides thereof, and saw teeth surfaces formed at both sides of said protruding block.

6. The golf bag as defined in claim 1, wherein said first bearing unit comprises operating blocks installed to be positioned at both sides of the protruding block of the main bearing unit, a shaft hole passing through the operating block, and a hooking jaw formed at the inside of the shaft hole so that the spring is hooked on the hooking jaw, said operating block comprises two stepped parts that are formed to correspond to the stepped parts of the protruding block, and saw teeth surfaces which are formed on the surfaces of said stepped parts, and thus when said protruding block is engaged with said operating block, a predetermined space is formed at the position of the stepped parts.

7. The golf bag as defined in claim 3, wherein said first bearing unit comprises operating blocks installed to be positioned at both sides of the protruding block of the main bearing unit, a shaft hole passing through the operating block, and a hooking jaw formed at the inside of the shaft hole so that the spring is hooked on the hooking jaw, said operating block comprises two stepped parts that are formed to correspond to the stepped parts of the protruding block, and saw teeth surfaces which are formed on the surfaces of said stepped parts, and thus when said protruding block is engaged with said operating block, a predetermined space is formed at the position of the stepped parts.

8. The golf bag as defined in claim 1, wherein said adjusting unit comprises a shaft inserted into said shaft holes and, a supporting instrument coupled to one end of said shaft, and a guide instrument coupled to the other end of said shaft, said adjusting unit is capable of horizontally moving said supporting instrument and said guide instrument, a cam is coupled to the end of the shaft by a pin, and a lever is attached to said cam.

9. The golf bag as defined in claim 3, wherein said adjusting unit comprises a shaft inserted into said shaft holes and, a supporting instrument coupled to one end of said shaft, and a guide instrument coupled to the other end of said shaft, said adjusting unit is capable of horizontally moving said supporting instrument and said guide instrument, a cam is coupled to the end of the shaft by a pin, and a lever is attached to said cam.

10. The golf bag as defined in claim 3, wherein said cover formed to cover the front face of said main plate comprises elongated guide slots formed in a longitudinal direction at both sides of said main plate for guiding said first leg, a first guide groove inwardly formed at the upper end of each guide slot, a second guide groove inwardly formed at the lower end of each guide slot, a guide groove for guiding said second leg at the center of the lower part of said cover.

11. The golf bag as defined in claim 1, wherein said leg unit comprises a V-shaped first leg for coupling its upper end part to said operation block of said first bearing unit, a second leg rotatably coupled with said bracket of said second bearing unit, and a trailing assembly rotatably coupled with the lower ends of said first and second legs, and also coupled to said wheel unit.

12. The golf bag as defined in claim 3, wherein said leg unit comprises a V-shaped first leg for coupling its upper end part to said operation block of said first bearing unit, a second leg rotatably coupled with said bracket of said second bearing unit, and a trailing assembly rotatably coupled with the lower ends of said first and second legs, and also coupled to said wheel unit.

* * * * *